United States Patent [19]

Simanainen

[11] Patent Number: 4,683,816

[45] Date of Patent: Aug. 4, 1987

[54] DRUM PRESS

[75] Inventor: Jyrki Simanainen, Savonlinna, Finland

[73] Assignee: Enso-Gutzeit Oy, Helsinki, Finland

[21] Appl. No.: 744,228

[22] Filed: Jun. 13, 1985

[30] Foreign Application Priority Data

Jul. 12, 1984 [FI] Finland ..... 842805

[51] Int. Cl.[4] ..... B30B 9/20

[52] U.S. Cl. ..... 100/121; 100/157

[58] Field of Search ..... 100/157, 117, 145, 146, 100/143, 148, 149, 150, 121, 905; 15/256.5

[56] References Cited

U.S. PATENT DOCUMENTS

| | | | |
|---|---|---|---|
| 635,868 | 10/1899 | Peck | 100/117 |
| 714,856 | 12/1902 | Birkholz | 100/157 X |
| 3,592,128 | 7/1971 | French | 100/145 |
| 3,753,399 | 8/1973 | Dessoris | 100/145 |
| 4,491,067 | 1/1985 | Kipelainen et al. | 100/157 X |
| 4,566,381 | 1/1986 | Nikulainen | 100/157 X |

*Primary Examiner*—Peter Feldman

*Attorney, Agent, or Firm*—Browdy and Neimark

[57] ABSTRACT

A drum press with a rotating dewatering drum, inside which is eccentrically located a press roll of which the outer surface together with the inner surface of the dewatering drum defines a press gap compressing mass, such as bark, and in conjunction with the dewatering drum a removal screw is provided which detaches the mass that has been pressed to adhere to the inner surface of the dewatering drum and removes it for the next treatment step. The portion of the removal screw which is used to detach the pressed mass comprises a separate screw section removably disposed on the shaft of the removal screw and which is replaceable with ease.

3 Claims, 2 Drawing Figures

DRUM PRESS

BACKGROUND OF THE INVENTION

The present invention concerns a drum press with a rotating dewatering drum inside which is eccentrically located a press roll, the outer surface of the press roll together with the inner surface of the dewatering drum, defining a press gap for compressing a mass, such as bark. The dewatering drum is provided with a removal screw which detaches the mass that has been pressed to adhere to the inner surface of the dewatering drum and removes it from the drum press for the next treatment step.

The shortcoming of the press of this type in prior art has been, specifically in the removal transport and scraping of the dried pressed goods from inside the dewatering drum, the service life of the screw, and the concommitant high power consumption after the edges of the screw's threads have become worn to be round. After said wear has taken place, one has been compelled in designs of prior art to dismount the entire screw and to repair it by grinding it to sharp condition again, and this has been an inconvenient and time-consuming operation and has prolonged the shut-down periods of the press.

OBJECTS OF THE INVENTION

The object of the present invention is to eliminate the drawbacks mentioned. The drum press of the invention is characterized in that the detaching part of the removal screw is a separate screw part located on the shaft of the removal screw and easy to dismount and to replace. As taught by the invention, part of the threads of the removal screw, expressly the rending part, which is located inside the dewatering drum, is removable by detaching the "bearing shield" attached to the side plate of the press together with the bearing, whereafter the replaceable screw section can be dismounted without dismounting the rest of the screw and a new or reconditioned replacement screw section can be installed. Moreover, no hoisting means is needed when operating as taught by the invention. The power consumption of the screw can be reduced, and its service life lengthened, by means of wear-resistant inserts mounted on the screw threads, which scrape the "pressed goods cake" off the inner periphery of the dewatering drum with minimal force, to be transported off by the screw.

An advantageous embodiment of the invention is characterized in that the screw section is located at that end of the screw which detaches the mass and that it is replaceable through this end. Hereby it becomes possible to replace the screw section with the simplest operations conceivable.

Another embodiment of the invention is characterized in that the detachable screw section can be turned 180 degrees about a transversal axis. Turning of the screw section is most rapidly accomplished; therefore it saves maintenance time besides making do with fewer spare screw sections. An advantageous embodiment of the invention is furthermore characterized in that the drive machinery for the removal screw is located at the discharge end of the removal screw. As a consequence, the drive machinery is not in the way when the screw is being replaced.

BRIEF DESCRIPTION OF THE DRAWINGS

The invention is described in the following with the aid of an example, reference being made to the attached drawing, wherein.

DETAILED DESCRIPTION OF THE INVENTION

Figure 1:
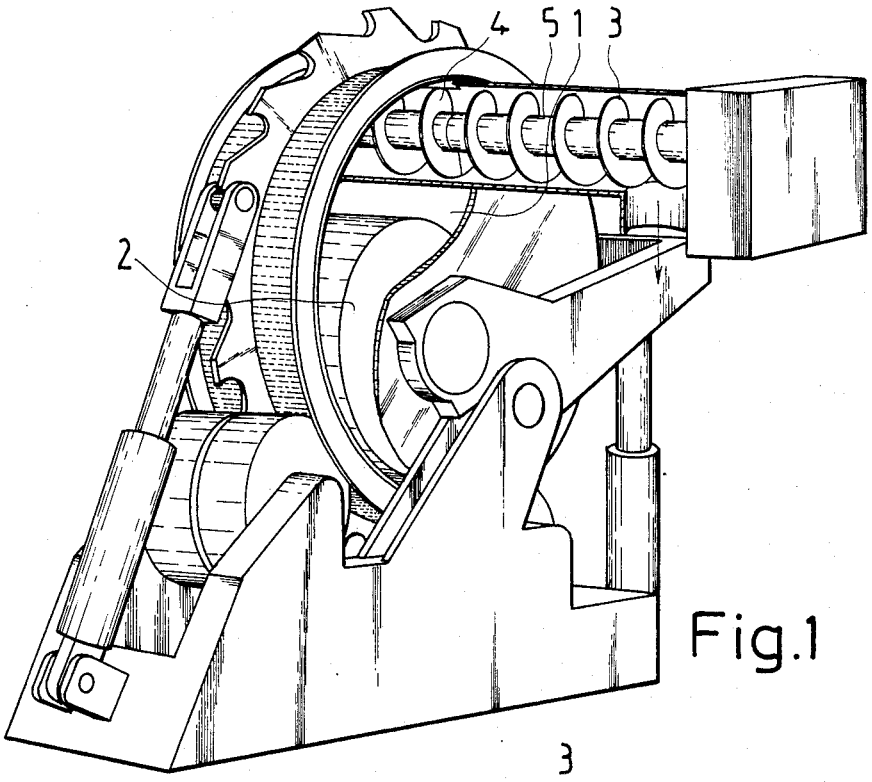
FIG. 1 presents the drum press in axonometric projection.
Figure 2:
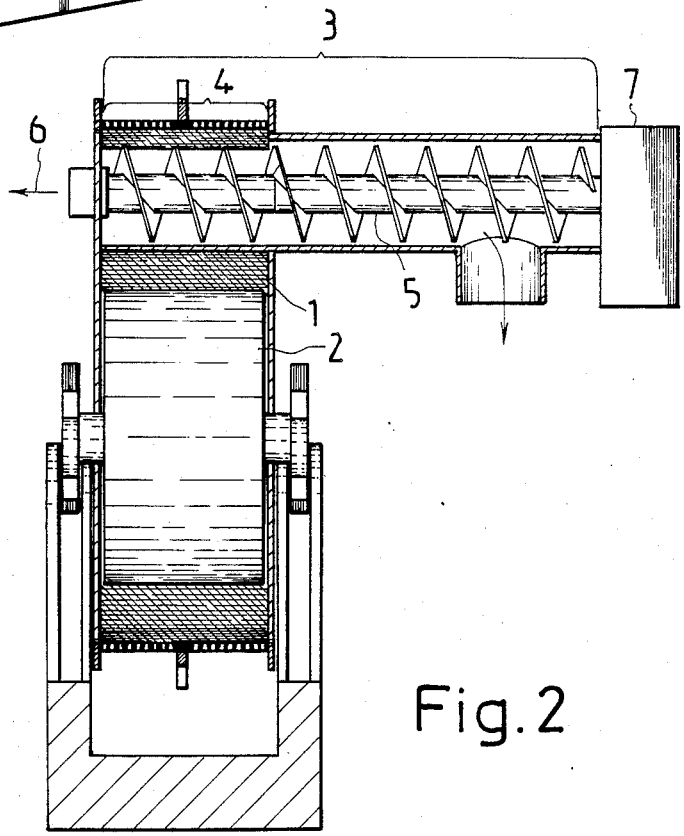
FIG. 2 presents the drum press, sectioned in part.

The drum press comprises a rotating dewatering drum 1, inside which is eccentrically disposed a press roll 2, the latter's outer surface together with the inner surface of the dewatering drum defining a press gap in which mass, such as bark, is pressed. In conjunction with the dewatering drum 1, a removal screw 3 is provided for detaching the mass that has been pressed to adhere to the inner surface of the dewatering drum and for carrying the removed mass to the next treatment step. As can be seen in FIGS. 2 and 3, removal screw 3 includes a helical screw portion 3*a* mounted about, and extending longitudinally along, a tubular shaft 3*b*. The tubular shaft 3*b* is supported concentrically about, and extends longitudinally along, a supporting shaft 5, the latter extending between the drive machinery 7 and a bearing box 8 located at a side plate of the drum press. Removal screw 3 essentially includes two portions; a first "detaching part" 4 which is provided for detaching the mass that has been pressed against the innner surface of the dewatering drum, and a second "transporting part" 3*b* which is provided for transporting the detached mass from the dewatering drum to a discharge region. The detaching part 4 is provided as a section separate from the transporting part 3*c* and is easily replaceable on the shaft 5 supporting the removal screw. The separable screw section is with another similar separable screw section exchangeable through the end by pulling it out of the side the drum press through the opening in which bearing box 8 is mounted, as indicated by arrow 6. The screw section can be inverted by turning it 180 degrees about a transversal axis, and this is accomplished in a fraction of the time which would be needed to recondition or replace the screw. The drive machinery 7 of the removal screw 3 is located adjacent the discharge end of the removal screw.

It is obvious to a person skilled in the art that the invention is not confined to the embodiment examples presented in the foregoing and that it may instead be modified within the scope of the claims following below.

I claim:

1. In combination with a drum press including a rotating dewatering drum having an inner surface against which wet bark is pressed to effect dewatering of the wet bark and a press roll supported eccentrically within the dewatering drum for compressing the wet bark in a gap defined between the press roll outer surface and the inner surface of the dewatering drum, a screw assembly for removing the compressed, dewatered bark from the inner surface of the dewatering drum, comprising:

a first portion located within said dewatering drum adjacent the inner surface, and a second portion extending coaxially with said first portion and laterally away from said inner surface, said first and second portions being separable from one another, whereby said first portion can be removed from said drum press without having to remove the entire screw assembly.

2. The screw assembly of claim 1, wherein the dewatering drum includes opposed, supporting side elements, one of said supporting side elements having mounted thereon drive means for driving the screw in rotation, the other of said supporting side elements including an opening, aligned with said first portion, through which said first portion can be extracted and a bearing assembly mounted in said opening, said screw assembly being supported at one end of said first portion disposed adjacent said other supporting side element by said bearing assembly and being supported at the opposite end by said drive means.

3. The screw assembly of claim 2, and further including a shaft supported between said bearing assembly and said drive means, said first and second portions being mounted side-by-side on, and coaxially about, said shaft.

* * * * *